US006565450B1

(12) United States Patent
Nakahara

(10) Patent No.: US 6,565,450 B1
(45) Date of Patent: May 20, 2003

(54) GOLF CLUB SET

(75) Inventor: Norihiko Nakahara, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 86 days.

(21) Appl. No.: 09/684,814

(22) Filed: Oct. 10, 2000

(30) Foreign Application Priority Data

Oct. 26, 1999 (JP) ..... 11-303373

(51) Int. Cl.[7] ..... A63B 53/10
(52) U.S. Cl. ..... 473/289
(58) Field of Search ..... 473/289, 290, 473/291, 300, 301, 302, 303

(56) References Cited

U.S. PATENT DOCUMENTS 3,871,649 A * 3/1975 Kilshaw
4,563,007 A * 1/1986 Bayliss
5,106,087 A * 4/1992 Simmons
5,192,073 A * 3/1993 Iwanaga
5,695,408 A * 12/1997 DeLaCruz
5,820,480 A * 10/1998 Cheng

FOREIGN PATENT DOCUMENTS

JP 10-328334 * 12/1998

* cited by examiner

*Primary Examiner*—Stephen Blau
(74) *Attorney, Agent, or Firm*—Finnegan, Henderson, Farabow, Garrett & Dunner, L.L.P.

(57) ABSTRACT

The present invention discloses a golf club set comprising: a plurality of golf clubs from long clubs to short clubs excluding a putter; and a tapered portion formed from a butt end to a tip end of each club shaft. An outer diameter of each shaft at the butt end is gradually reduced as a club count becomes larger, and a rate of tapering between the butt end and a position of 200 mm from the butt end is gradually reduced as the club count becomes larger.

10 Claims, 2 Drawing Sheets

A
B
C
1
2
3

GOLF CLUB SET

BACKGROUND OF THE INVENTION

The present invention relates to a golf club set and, more particularly, to one capable of enabling a long club to have a greater carry, and a short club to have a higher degree of controllability including accuracy in the direction and the carry of a batted ball.

Conventionally, among a plurality of golf clubs constituting a golf club set, the long clubs of smaller club counts (referred to as counts, hereinafter) have been designed to have greater carries of batted balls while the short clubs of larger counts have been designed with importance placed on controllability so as to have accuracy in the directions and the target carries of batted balls.

To satisfy such requested performances, various golf club sets have hitherto been contrived. For example, Japanese patent application Kokai publication No. 2-224679 describes a golf club set, which is designed to gradually reduce the degrees of twisting per unit length as a count becomes larger by gradually increasing the outer diameters of fiber reinforced plastic shafts as the count becomes larger thereby delaying a head return of short clubs at the time of swinging. Japanese patent application Kokai publication No. 5-277211 describes a golf club set, which is designed to gradually increase the diameters of grips as count becomes larger.

For such conventional golf club sets, however, improvements were limited to only long or short clubs, and no improvements have been made on the entire club set. Therefore, there is a need to enhance the function of the entire golf club set from long to short clubs to a much greater degree.

SUMMARY OF THE INVENTION

The object of the present invention is to provide a golf club set capable of improving its entire performance by further increasing cries for long clubs and achieve greater controllability for short clubs.

In order to achieve the foregoing object, according to the present invention, a golf club set comprises: a plurality of golf clubs from long clubs to short clubs excluding a putter; and a tapered portion formed from a butt end to a tip end of each club shaft. In this case, an outer diameter of each shaft at the butt end is gradually reduced as a club count becomes larger, and a rate of tapering between the butt end and a position of 200 mm from the butt end (referred to as a middle point, hereinafter) is gradually reduced as the club count becomes larger.

As described above, in the case of the long club, since the outer diameter of the shaft in the butt end portion is large, the club is felt to be light when the grip is held. Therefore, a head weight can be increased in order to raise a meeting ratio to a ball. Furthermore, a hard feeling can be obtained even when the shaft is softened. Therefore, it is possible to increase a carry much more by setting an amount of shaft bending to be large in such a way as to increase a head speed.

In the case of the short club, since the outer diameter of the shaft m the butt end portion is small, a bend point of the shaft becomes higher (closer to the grip). Thus, it is possible to enhance ball controllability.

DETAILED DESCRIPTION OF THE PREFERRED EMBODIMENTS

Figure 1:
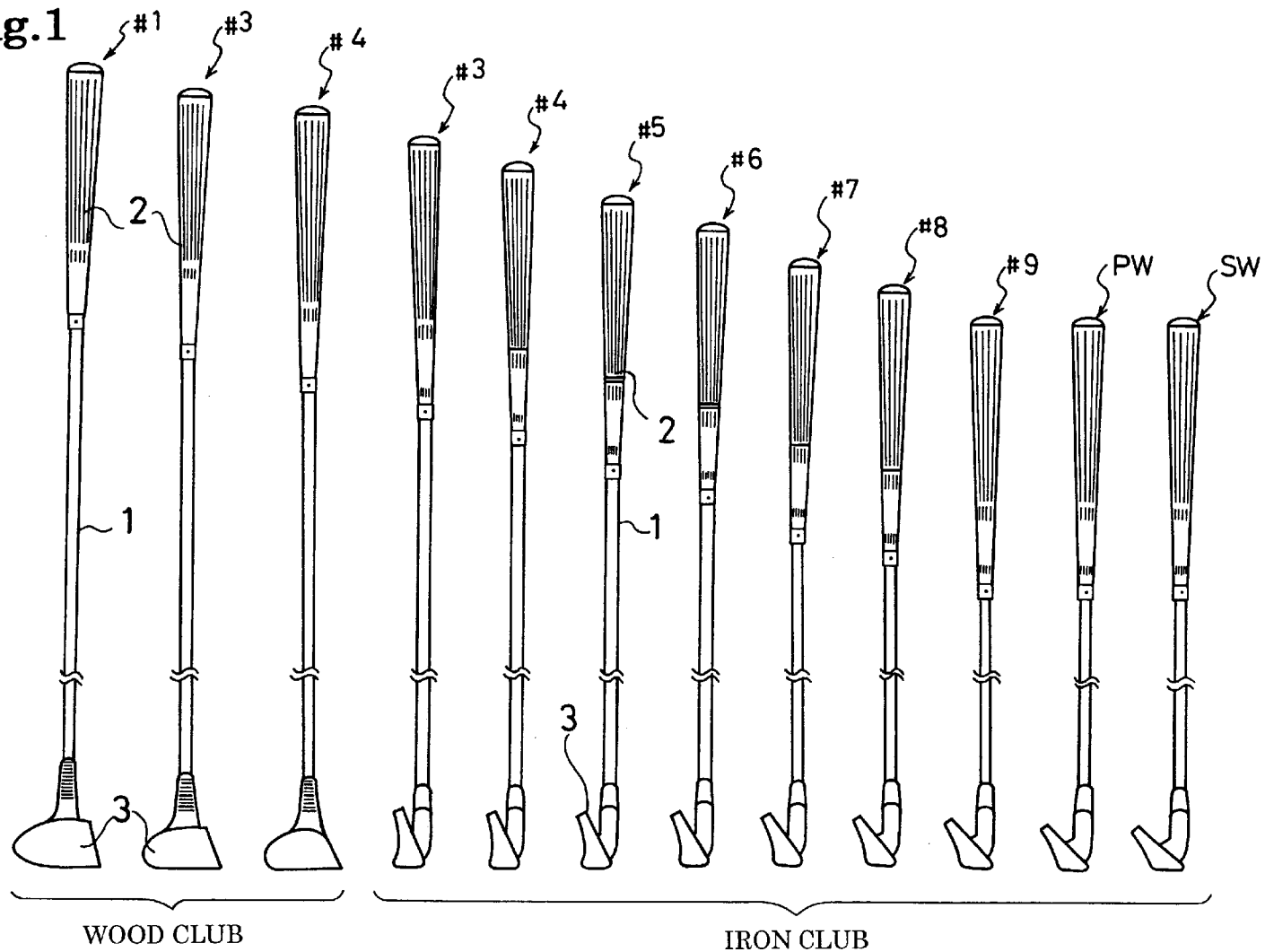
FIG. 1 is a side view showing an example of a combination of golf clubs constituting a golf club set of the present invention.

FIG. 1 shows the example of a club combination of a golf club set of the present invention. This golf club set is composed of wood clubs of 1st, 3rd and 4th counts, iron clubs of 3rd to 9th counts, a pitching wedge (PW) and a sand wedge (SW). Each of these wood and iron clubs comprises a grip 2 fitted to the butt portion of a shaft 1 so as to cover the butt portion, and a head 3 attached to a tip portion of the shaft 1.

The possible arrangement of the golf club set of the present invention includes not only the combination of wood and iron clubs like that shown in FIG. 1, but also the constitution of all the clubs, long and short, of iron clubs. In either case, however a putter is excluded from the club combination.

Figures 2A, 2B, 2C:
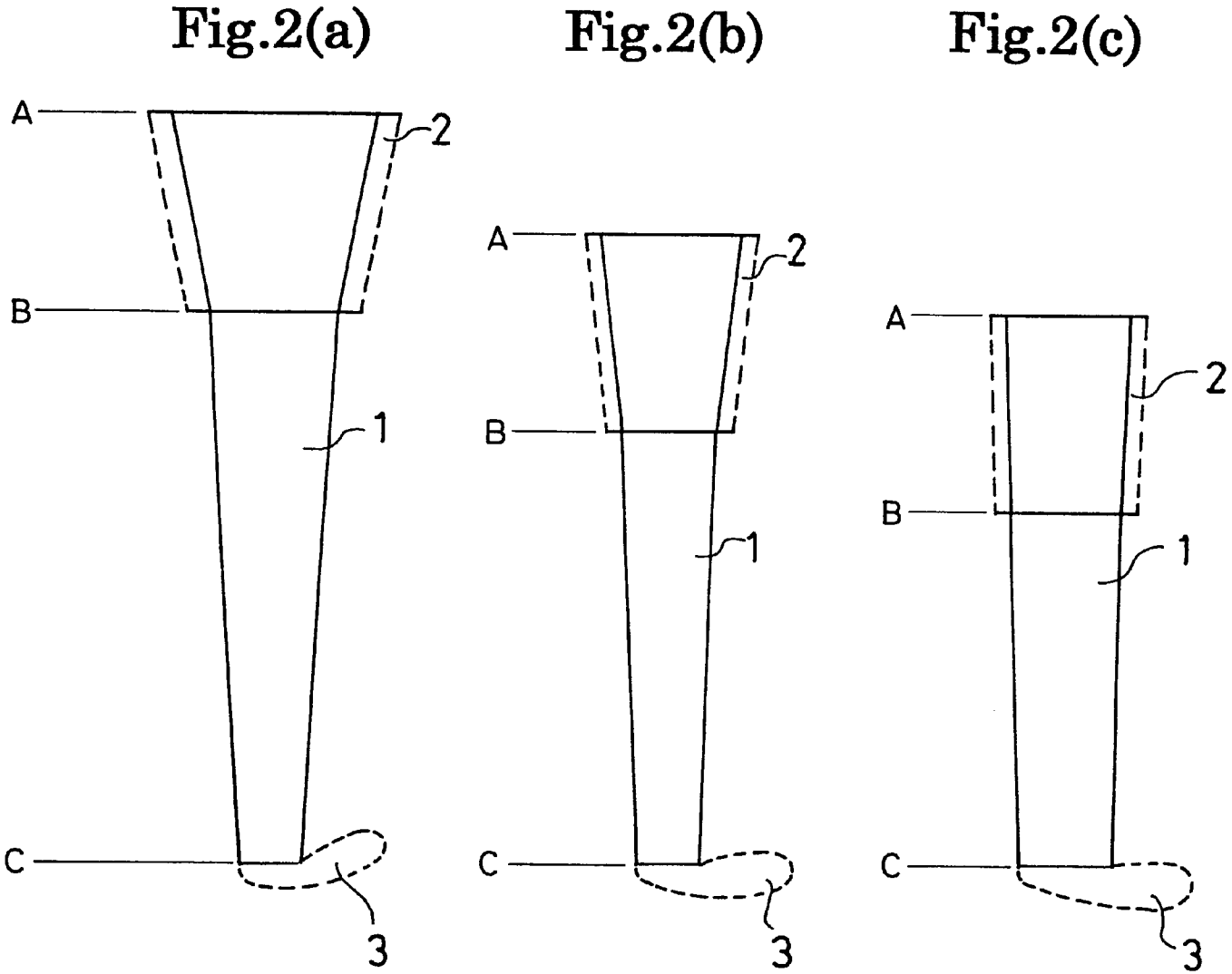
FIGS. 2(*a*) to 2(*c*) are views, each of them illustrating a shape of one of the golf clubs constituting the golf club set of the present invention.

FIGS. 2(*a*) to 2(*c*) respectively show golf clubs constituting the golf club set of the present invention, specifically FIG. 2(*a*) showing a long club; FIG. 2(*b*) a middle club; and FIG. 2(*c*) a short club. In each of FIGS. 2(*a*) to 2(*c*), a reference code A denotes a butt end of a shaft B a middle point; and C a tip end of a shaft. Each shaft has a tapered portion formed to gradually reduce its outer diameter from the butt end A to the tip end B.

A feature of the golf club set of the present invention is that an outer diameter of each shaft 1 at its butt end A is gradually reduced as a club count becomes larger from the long, the middle to the short clubs, while a rate of tapering from the butt end A to the middle point B between A and B) is gradually reduced as the club count becomes larger.

In the foregoing constitution, preferably, a rate of tapering from the middle point B to the tip end C Between B and C) should be gradually reduced as the club count becomes larger.

In addition, in the foregoing constitution, preferably, an outer diameter at the butt end A should be set in the range of 10.0 mm to 30.0 mm. If a largest outer diameter at the butt end A in the club set exceeds 30.0 mm, controllability provided for the long club becomes insufficient. Conversely, if a smallest outer diameter at the butt end A in the set is less than 10.0 mm, then a carry provided for the short club becomes insufficient A length between A and B is set equal to 200 mm, which is substantially equivalent to the position of fitting a grip. A rate of tapering between A and B is set equal to or lower than 100/1000, more preferably in the range of 3/1000 to 40/1000. If a rate of tapering between A and B is too small, the effect of enhancing controllability for the short club becomes insufficient. Conversely, if a rate of tapering is too large, then the effect of increasing a carry for the long club becomes insufficient.

In each golf club, a rate of tapering between B and C may be larger/smaller than or equal to that between A and B. Preferably, however, it should be smaller than the rate of tapering between A and B. A rate of tapering between B and C should preferably be set in the range of 3/1000 to 20/1000. If the rate of tapering between B and C goes off the above range, shaft balance will be deteriorated.

The rates of tapering between A and B and between B and C are respectively calculated based on (outer diameter of A−outer diameter of B)/length between A and B) and (outer diameter of B−outer diameter of C)/length between B and C). Tapering does not need to be always constant between A and B or between B and C, and a taper variation point may be present either between A and B or between B and C.

Preferably, a value of rate of tapering between A and B)−(rate of tapering between B and C) should be gradually reduced as the club count becomes larger In this way, a low bend paint is set for the long club because of large tapering between B and C, which facilitates high flying of a batted ball. Hence, it is possible to increase a carry. A higher bend point is set for a shorter club because of smaller tapering between B and C and, hence, ball controllability can be enhanced more.

Further, in the golf club set of the present invention, a thickness of a grip fitted to the butt end portion of each shaft may be gradually increased as the club count becomes larger, and outer diameters of the fitted grips may be set equal among the club counts. Alternatively, a thickness of the grip may be gradually increased as the club count becomes larger, and an outer diameter of the fitted grip may be gradually increased as the club count becomes larger Otherwise, grips fitted to the butt end portion may be set equal in thickness among the club counts, and an outer diameter of each of the fitted grips may be gradually reduced as the club count becomes larger.

Preferably, however, as in the former two cases, if a thick grip is fitted to the butt end portion of a short club to set a grip diameter to be large, counterbalance is applied to move a shaft center of gravity toward the grip portion, which makes it difficult to feel a head weight. Hence, the club can be swung more smoothly, and unnecessary wrist movements can be suppressed. Therefore, the accuracy of a direction and a carry can be further improved.

Apparently, because of the foregoing constitution of the long to short clubs of the golf club set of the present invention, as described above, a carry can be increased more for a longer club, and more accurate controllability can be provided for a shorter club.

Example

For manufacturing of a golf club set comprising totally 13 golf clubs: wood clubs of 1st, 3rd and 4th counts; irons clubs of 3rd to 9th counts; a pitching wedge (#P); an approaching wedge (#A); and a sand wedge (#S), the inventors manufactured 5 types of golf club sets including embodiments 1 to 4 of the present invention and a conventional example. As shown in Tables 1 to 5, these golf club sets are different from one another in the following respects: an outer diameter of each club shaft at a butt end A; a shaft outer diameter at a middle point B; a rate of tapering between the butt end A and the middle paint B; a rate of tapering between the middle point B and a tip end C; a grip thickness; and an outer diameter at the middle point C after grip fitting.

Among these golf club sets, the club sets of the embodiments 1 to 4 have common dimensions in outer diameters at the butt ends A, outer diameters at the middle points B and rates of tapering between A and B, and the outer diameters at the butt ends A, the outer diameters at the middle points B and the rates of tapering between A and B are gradually reduced as a club count becomes larger.

In the embodiment 1, the rates of tapering between B and C are equal among club counts, grips are also equal in thickness, and after the fitting of each grip, a grip diameter is gradually reduced as a club count becomes larger.

In the embodiments 2 to 4, rates of tapering between B and C are equal among them, and each rate of tapering between B and C is gradually reduced as a club count becomes larger.

In the embodiment 2, each grip diameter after fitting is gradually reduced as a club count becomes larger, and grips are equal in thickness among club counts.

In each of the embodiments 3 and 4, a grip thickness is gradually increased as a club count becomes larger. In the embodiment 3, grips after fitting are equal in diameter among club counts. In the embodiment 4, each grip diameter is gradually increased as a club count becomes larger.

In the conventional example, outer diameters at butt ends A, outer diameters at middle points B and grip diameters after fitting are randomly changed by a difference of about 0.1 mm among club counts. Rates of tapering between A and B and between B and C are respectively equal among wood club counts and among iron clubs, and the same holds true for thickness of grips.

For these 5 types of golf club sets, 5 skilled testers checked carries and controllability, and the results are respectively shown in Tables 1 to 5.

As regards controllability, evaluation was made based on a distance of the landing point of a batted ball deviated from a target point, and an inverse number of an average value among the testers was used for the result of testing. Controllability is represented by an index with that of the golf club set of the conventional example set at 100 (reference). The larger the index value becomes, the better the result shows.

TABLE 1

| | | Club count | Outer diameter at butt end (A) (mm) | Outer diameter at middle point (B) (mm) | Rate of tapering between A and B $\times 10^{-3}$ | Rate of tapering between B and C $\times 10^{-3}$ | Grip thickness (mm) | Grip outer diameter after fitting (mm) | Carry (Index) | Controllability (Index) |
|---|---|---|---|---|---|---|---|---|---|---|
| Conventional Example | Wood | #1 | 15.2 | 15.0 | 1.0 | 8.5 | 2.5 | 20.0 | 100 | 100 |
| | | #3 | 15.4 | 15.2 | 1.0 | 8.5 | 2.5 | 20.2 | 100 | 100 |
| | | #4 | 15.4 | 15.2 | 1.0 | 8.5 | 2.5 | 20.2 | 100 | 100 |
| | Iron | #3 | 14.7 | 13.1 | 8.0 | 8.0 | 2.5 | 18.1 | 100 | 100 |
| | | #4 | 14.6 | 13.0 | 8.0 | 8.0 | 2.5 | 18.0 | 100 | 100 |
| | | #5 | 14.5 | 12.9 | 8.0 | 8.0 | 2.5 | 17.9 | 100 | 100 |
| | | #6 | 14.6 | 13.0 | 8.0 | 8.0 | 2.5 | 18.0 | 100 | 100 |
| | | #7 | 14.7 | 13.1 | 8.0 | 8.0 | 2.5 | 18.1 | 100 | 100 |
| | | #8 | 14.5 | 12.9 | 8.0 | 8.0 | 2.5 | 17.9 | 100 | 100 |
| | | #9 | 14.6 | 13.0 | 8.0 | 8.0 | 2.5 | 18.0 | 100 | 100 |
| | | #P | 14.7 | 13.1 | 8.0 | 8.0 | 2.5 | 18.1 | 100 | 100 |
| | | #A | 14.7 | 13.1 | 8.0 | 8.0 | 2.5 | 18.1 | 100 | 100 |
| | | #S | 14.6 | 13.0 | 8.0 | 8.0 | 2.5 | 18.0 | 100 | 100 |

Note:
Middle point (B): position of 200 mm from butt end (A)
Between A and B: from butt end (A) to middle point (B)
Between B and C: from middle point (B) to tip end (C)
Grip thickness: thickness at middle point (B)
Grip outer diameter after fitting: outer diameter at middle point (B)

TABLE 2

| | | Club count | Outer diameter at butt end (A) (mm) | Outer diameter at middle point (B) (mm) | Rate of tapering between A and B $\times 10^{-3}$ | Rate of tapering between B and C $\times 10^{-3}$ | Grip thick-ness (mm) | Grip outer diameter after fitting (mm) | Carry (Index) | Controlla-bility (Index) |
|---|---|---|---|---|---|---|---|---|---|---|
| Embodi-ment 1 | Iron | #1 | 23.2 | 17.8 | 27.0 | 9.0 | 2.5 | 22.8 | 115 | 102 |
| | | #3 | 21.6 | 16.7 | 24.4 | 9.0 | 2.5 | 21.7 | 113 | 102 |
| | | #4 | 20.0 | 15.6 | 21.8 | 9.0 | 2.5 | 20.6 | 113 | 102 |
| | Iron | #3 | 18.5 | 15.1 | 17.0 | 9.0 | 2.5 | 20.1 | 108 | 106 |
| | | #4 | 17.5 | 14.6 | 14.5 | 9.0 | 2.5 | 19.6 | 105 | 106 |
| | | #5 | 16.6 | 13.9 | 13.4 | 9.0 | 2.5 | 18.9 | 103 | 106 |
| | | #6 | 15.8 | 13.3 | 12.4 | 9.0 | 2.5 | 18.3 | 102 | 105 |
| | | #7 | 14.9 | 12.6 | 11.3 | 9.0 | 2.5 | 17.6 | 101 | 105 |
| | | #8 | 14.3 | 12.4 | 9.5 | 9.0 | 2.5 | 17.4 | 101 | 108 |
| | | #9 | 13.6 | 12.0 | 7.8 | 9.0 | 2.5 | 17.0 | 101 | 108 |
| | | #P | 13.0 | 11.8 | 6.0 | 9.0 | 2.5 | 16.8 | 101 | 109 |
| | | #A | 13.0 | 11.8 | 6.0 | 9.0 | 2.5 | 16.8 | 101 | 109 |
| | | #S | 13.0 | 11.8 | 6.0 | 9.0 | 2.5 | 16.8 | 101 | 109 |

Note:
Middle point (B): position of 200 mm from butt end (A)
Between A and B: from butt end (A) to middle point (B)
Between B and C: from middle point (B) to tip end (C)
Grip thickness: thickness at middle point (B)
Grip outer diameter after fitting: outer diameter at middle point (B)

TABLE 3

| | | Club count | Outer diameter at butt end (A) (mm) | Outer diameter at middle point (B) (mm) | Rate of tapering between A and B $\times 10^{-3}$ | Rate of tapering between B and C $\times 10^{-3}$ | Grip thick-ness (mm) | Grip outer diameter after fitting (mm) | Carry (Index) | Controlla-bility (Index) |
|---|---|---|---|---|---|---|---|---|---|---|
| Embodi-ment 2 | Wood | #1 | 23.2 | 17.8 | 27.0 | 9.5 | 2.5 | 22.8 | 120 | 103 |
| | | #3 | 21.6 | 16.7 | 24.4 | 9.5 | 2.5 | 21.7 | 118 | 104 |
| | | #4 | 20.0 | 15.6 | 21.8 | 9.5 | 2.5 | 20.6 | 116 | 104 |
| | Iron | #3 | 18.5 | 15.1 | 17.0 | 9.5 | 2.5 | 20.1 | 110 | 108 |
| | | #4 | 17.5 | 14.6 | 14.5 | 9.0 | 2.5 | 19.6 | 108 | 108 |
| | | #5 | 16.6 | 13.9 | 13.4 | 8.5 | 2.5 | 18.9 | 107 | 109 |
| | | #6 | 15.8 | 13.3 | 12.4 | 8.0 | 2.5 | 18.3 | 105 | 109 |
| | | #7 | 14.9 | 12.6 | 11.3 | 7.5 | 2.5 | 17.6 | 104 | 109 |
| | | #8 | 14.3 | 12.4 | 9.5 | 7.0 | 2.5 | 17.4 | 103 | 112 |
| | | #9 | 13.6 | 12.0 | 7.8 | 6.5 | 2.5 | 17.0 | 102 | 112 |
| | | #P | 13.0 | 11.8 | 6.0 | 6.0 | 2.5 | 16.8 | 101 | 115 |
| | | #A | 13.0 | 11.8 | 6.0 | 6.0 | 2.5 | 16.8 | 101 | 115 |
| | | #S | 13.0 | 11.8 | 6.0 | 6.0 | 2.5 | 16.8 | 101 | 115 |

Note:
Middle point (B): position of 200 mm from butt end (A)
Between A and B: from butt end (A) to middle point (B)
Between B and C: from middle point (B) to tip end (C)
Grip thickness: thickness at middle point (B)
Grip outer diameter after fitting: outer diameter at middle point (B)

TABLE 4

| | | Club count | Outer diameter at butt end (A) (mm) | Outer diameter at middle point (B) (mm) | Rate of tapering between A and B $\times 10^{-3}$ | Rate of tapering between B and C $\times 10^{-3}$ | Grip thick-ness (mm) | Grip outer diameter after fitting (mm) | Carry (Index) | Controlla-bility (Index) |
|---|---|---|---|---|---|---|---|---|---|---|
| Embodi-ment 3 | Wood | #1 | 23.2 | 17.8 | 27.0 | 9.5 | 2.5 | 22.8 | 121 | 105 |
| | | #3 | 21.6 | 16.7 | 24.4 | 9.5 | 3.05 | 22.8 | 119 | 106 |
| | | #4 | 20.0 | 15.6 | 21.8 | 9.5 | 3.6 | 22.8 | 117 | 106 |
| | Iron | #3 | 18.5 | 15.1 | 17.0 | 9.5 | 3.85 | 22.8 | 112 | 110 |
| | | #4 | 17.5 | 14.6 | 14.5 | 9.0 | 4.1 | 22.8 | 111 | 110 |
| | | #5 | 16.6 | 13.9 | 13.4 | 8.5 | 4.45 | 22.8 | 110 | 110 |
| | | #6 | 15.8 | 13.3 | 12.4 | 8.0 | 4.75 | 22.8 | 107 | 110 |
| | | #7 | 14.9 | 12.6 | 11.3 | 7.5 | 5.1 | 22.8 | 106 | 110 |
| | | #8 | 14.3 | 12.4 | 9.5 | 7.0 | 5.2 | 22.8 | 106 | 114 |
| | | #9 | 13.6 | 12.0 | 7.8 | 6.5 | 5.4 | 22.8 | 105 | 114 |

TABLE 4-continued

| | Club count | Outer diameter at butt end (A) (mm) | Outer diameter at middle point (B) (mm) | Rate of tapering between A and B $\times 10^{-3}$ | Rate of tapering between B and C $\times 10^{-3}$ | Grip thickness (mm) | Grip outer diameter after fitting (mm) | Carry (Index) | Controllability (Index) |
|---|---|---|---|---|---|---|---|---|---|
| | #P | 13.0 | 11.8 | 6.0 | 6.0 | 5.5 | 22.8 | 104 | 116 |
| | #A | 13.0 | 11.8 | 6.0 | 6.0 | 5.5 | 22.8 | 104 | 116 |
| | #S | 13.0 | 11.8 | 6.0 | 6.0 | 5.5 | 22.8 | 104 | 117 |

Note:
Middle point (B): position of 200 mm from butt end (A)
Between A and B: from butt end (A) to middle point (B)
Between B and C: from middle point (B) to tip end (C)
Grip thickness: thickness at middle point (B)
Grip outer diameter after fitting: outer diameter at middle point (B)

TABLE 5

| | | Club count | Outer diameter at butt end (A) (mm) | Outer diameter at middle point (B) (mm) | Rate of tapering between A and B $\times 10^{-3}$ | Rate of tapering between B and C $\times 10^{-3}$ | Grip thickness (mm) | Grip outer diameter after fitting (mm) | Carry (Index) | Controllability (Index) |
|---|---|---|---|---|---|---|---|---|---|---|
| Embodiment 4 | Wood | #1 | 23.2 | 17.8 | 27.0 | 9.5 | 2.5 | 22.8 | 123 | 107 |
| | | #3 | 21.6 | 16.7 | 24.4 | 9.5 | 3.15 | 23.0 | 121 | 109 |
| | | #4 | 20.0 | 15.6 | 21.8 | 9.5 | 3.7 | 23.0 | 120 | 109 |
| | Iron | #3 | 18.5 | 15.1 | 17.0 | 9.5 | 4.0 | 23.1 | 118 | 111 |
| | | #4 | 17.5 | 14.6 | 14.5 | 9.0 | 4.35 | 23.3 | 117 | 112 |
| | | #5 | 16.6 | 13.9 | 13.4 | 8.5 | 4.8 | 23.5 | 115 | 111 |
| | | #6 | 15.8 | 13.3 | 12.4 | 8.0 | 5.2 | 23.7 | 112 | 111 |
| | | #7 | 14.9 | 12.6 | 11.3 | 7.5 | 5.65 | 23.9 | 112 | 112 |
| | | #8 | 14.3 | 12.4 | 9.5 | 7.0 | 5.8 | 24.0 | 112 | 115 |
| | | #9 | 13.6 | 12.0 | 7.8 | 6.5 | 6.25 | 24.5 | 113 | 116 |
| | | #P | 13.0 | 11.8 | 6.0 | 6.0 | 6.6 | 25.0 | 114 | 118 |
| | | #A | 13.0 | 11.8 | 6.0 | 6.0 | 7.1 | 26.0 | 114 | 119 |
| | | #S | 13.0 | 11.8 | 6.0 | 6.0 | 7.1 | 26.0 | 114 | 120 |

Note:
Middle point (B): position of 200 mm from butt end (A)
Between A and B: from butt end (A) to middle point (B)
Between B and C: from middle point (B) to tip end (C)
Grip thickness: thickness at middle point (B)
Grip outer diameter after fitting: outer diameter at middle point (B)

The followings can be understood from Tables 1 to 5. Specifically, in the embodiment 1, compared with the golf club set of the conventional example, a shaft effect is provided. At the long clubs, a low bend point is set because of large diameter between A and B to increase a carry. At the short clubs, a high bend paint is set because of a small diameter between A and B to enhance controllability In the embodiment 2, compared with the club set of the embodiment 1, a further shaft effect is provided. At the long clubs, a low bend point is set because of a large rate of tapering between B and C to increase a carry. At the short clubs, a high bend point is set because of a small rate of tapering between B and C to enhance controllability.

In each of the embodiments 3 and4, a grip diameter is larger at the short clubs than that at the long clubs, because of a thicker grip and a larger grip diameter after fitting. Hence, controllability is enhanced particularly at the short club side. This effect is more prominent in the embodiment 4.

As described above, according to the golf club set of the present invention, a carry is increased more at the longer clubs, and controllability is enhanced more at the shorter clubs. As a result, it is possible to improve the entire performance of the golf clubs constituting the golf club set.

What is claimed is:

1. A golf club set comprising:

a plurality of golf clubs from long clubs to short clubs excluding a putter; and a tapered portion formed from a butt end to a tip end of each club shaft, wherein an outer diameter of each shaft at the butt end is gradually reduced as a club count becomes larger, and a rate of tapering between the butt end and a position of 200 mm from the butt end is gradually reduced as the club count becomes larger.

2. The golf club set according to claim 1, wherein a rate of tapering between the position of 200 mm from the butt end and the tip end is gradually reduced as the club count becomes larger.

3. The golf club set according to claim 1, wherein the outer diameter of the shaft at the butt end is set in a range of 10.0 mm to 30.0 mm.

4. The golf club set according to claim 1, wherein a rate of tapering between the butt end and the position of 200 mm from the butt end is not more than 100/1000.

5. The golf club set according to claim 1, wherein a rate of tapering between the butt end and the position of 200 mm from the butt end is set in a range of 3/1000 to 40/1000.

6. The golf club set according to claim 1, wherein for each of the golf clubs, a rate of tapering between the position of 200 mm from the butt end of the shaft and the tip end is set smaller than a rate of tapering between the butt end and the position of 200 mm from the butt end.

7. The golf club set according to claim 1, wherein a rate of tapering between the position of 200 mm from the butt end and the tip end is set in a range of 3/1000 to 20/1000.

8. The golf club set according to any one of claims 1 to 7, wherein a thickness of a grip fitted to the butt end portion is gradually increased as the club count becomes larger, and outer diameters of the fitted grips are set equal among the club counts.

9. The golf club set according to any one of claims 1 to 7, wherein a thickness of a grip fitted to the butt end portion is gradually increased as the club count becomes larger, and an outer diameter of the fitted grip is gradually increased as the club count becomes larger.

10. The golf club set according to any one of claims 1 to 7, wherein grips fitted to the butt end portions are set equal in thickness among the club counts, and an outer diameter of each of the fitted grips is gradually reduced as the club count becomes larger.

* * * * *